US005417632A

United States Patent [19]

Williamson

[11] Patent Number: 5,417,632

[45] Date of Patent: May 23, 1995

[54] EXERCISE APPARATUS

[76] Inventor: Neil Williamson, 1117 Royal Oaks, Jamesville, Wis. 53545

[21] Appl. No.: 154,952

[22] Filed: Nov. 19, 1993

[51] Int. Cl.[6] ..... A63B 21/06

[52] U.S. Cl. ..... 482/97; 482/100; 482/137

[58] Field of Search ..... 432/94, 97–104; 482/133, 135–137

[56] References Cited

U.S. PATENT DOCUMENTS

| | | | |
|---|---|---|---|
| 3,905,599 | 9/1975 | Mazman | 482/98 |
| 4,093,213 | 6/1978 | Coker et al. | 482/98 |
| 4,336,934 | 6/1982 | Hanagan et al. | 482/97 X |
| 4,354,675 | 10/1982 | Barclay et al. | 482/98 |
| 4,357,010 | 11/1982 | Telle | 482/97 |
| 4,546,970 | 10/1985 | Mahnke | 482/98 |
| 4,799,670 | 1/1989 | Williamson | 482/97 |
| 4,872,670 | 10/1989 | Nichols | 482/97 X |
| 5,058,884 | 10/1991 | Fuller, Sr. | 482/97 |

*Primary Examiner*—Richard J. Apley
*Assistant Examiner*—John Mulcahy
*Attorney, Agent, or Firm*—David J. Archer

[57] ABSTRACT

An exercise apparatus is disclosed for exercising a user thereof. The apparatus includes a frame and an elongate beam having a first and a second end. The beam is pivotally secured to the frame about a first pivotal axis disposed between the first and the second end of the beam. A user operated arrangement having a first and a second extremity is connected to the beam between the first end of the beam and the first pivotal axis. The arrangement is such that in use of the apparatus, when the user is exercising, the user exerts a variable force through the user operated arrangement, the variable force being transmitted to the beam for pivoting the beam about the first pivotal axis. Weights are pivotally secured to the frame such that in use of the apparatus, movement of the weights from a first to a second disposition thereof is permitted. A linkage extends from a second end of the beam to the weights such that in use of the apparatus during the beginning of an exercise, the weights are disposed in the first disposition thereof so that a minimal force is required to maintain the weights from movement thereof to the second disposition. However, during further exercising movement of the user, a further force greater than the minimal force is required in order to counteract a tendency for the weights to move from the first to the second disposition thereof so that the variable force is required by the user during use of the apparatus.

10 Claims, 4 Drawing Sheets

EXERCISE APPARATUS

BACKGROUND OF THE INVENTION

1. Field of the Invention

The present invention relates to an apparatus for exercising a user thereof. More specifically, the present invention relates to an exercise apparatus which enables a user thereof to apply a variable force during use of the apparatus.

2. Information Disclosure Statement

In a typical prior art exercise apparatus, the user thereof is required to exert a force to lift one or more weights through a series of exercise repetitions or cycles in order to exercise the user's muscles. Moreover, when the user has become exhausted by completing a certain number of lifting repititions (reps), the exercise is completed.

However, it has been discovered by the inventor of the subject invention that psychologically, if the user is able to begin the exercise sequence by lifting a comparitively small weight and then without stopping is able to increase the amount of weights lifted, such enables the user to continue such exercise so as to complete more repititions than is possible when lifting the heavier weight initially and through the entire exercising operation.

Furthermore, Applicant has discovered that when the user is unable to complete another lifting repitition, the user in fact is able to complete more lifting repitions if the weights are reduced.

Therefore, according to the present invention, the user is able to complete a more extended exercise than is possible with the prior art arrangements.

Therefore, it is a primary objective of the present invention to provide an exercise apparatus which permits a user thereof to initially lift a weight through one or more cycles and there after lift an increased weight through an additional number of cycles and subsequently completing a bonus exercise by lifting a reduced weight through yet a further number of cycles in order to complete the exercise.

Other objects and advantages of the present invention will become readily apparent to those skilled in the art by a consideration of the detailed description contained hereinafter taken in conjunction with the annexed drawings.

Those skilled in the art will appreciate that with regard to the range of motion of for example the user's arm during an exercise, the maximum stress is put on the relevant muscle wherever desired, preferably at a point where the muscle is somewhat extended and at its strongest point, then the stress diminishes to nothing as the muscle contracts.

SUMMARY OF THE INVENTION

The present invention relates to an exercise apparatus and method of using the same for exercising a user thereof.

The exercise apparatus includes a frame and an elongate beam having a first and a second end. The beam is pivotally secured to the frame about a first pivotal axis which is disposed between the first and the second end of the beam.

A user operated means has a first and a second extremity. The user operated means is connected to the beam between the first end of the beam and the first pivotal axis. The arrangement is such that in use of the apparatus, when the user is exercising, the user exerts a variable force through the user operated means. The variable force is transmitted to the beam for pivoting the beam about the first pivotal axis.

Weighted means are pivotally secured to the frame such that in use of the apparatus, movement of the weighted means from a first to a second disposition thereof is permitted.

Linkage means extend from the second end of the beam to the weighted means such that in use of the apparatus, during the beginning of an exercise, the weighted means is disposed in the first disposition thereof so that a minimal force is required to maintain the weighted means from movement thereof from the first to the second disposition. However, during further exercising movement of the user, a further force greater than the minimal force is required in order to counteract a tendency of the weighted means to move from the first towards the second disposition thereof. The arrangement is such that the variable force is applied by the user during use of the apparatus.

In a more specific embodiment of the present invention, the frame includes an A-shaped central portion having a first and a second leg, the first leg thereof pivotally supporting the weighted means. A limiting portion is rigidly secured to the first leg for limiting movement of the weighted means such that when the weighted means pivots to the second disposition thereof, further movement of the weighted means is inhibited by the limiting portion.

A beam supporting portion has a proximal and a distal end. The proximal end of the supporting portion is rigidly secured to the second leg and extends therefrom. The arrangement is such that the first pivotal axis is disposed between the proximal and the distal end of the supporting portion.

The beam supporting portion also includes a first and a second rail portion. The first pivotal axis extends normally through the rail portions.

The beam also includes adjustable anchor means for adjustably securing the first extremity of the user operated means to the beam such that selective securing of the first extremity at a variable distance from the first pivotal axis of the beam is permitted.

The anchor means includes a saddle which is rigidly secured to the first extremity of the user operated means for co-operating with and slideably engaging the beam.

Locking means are secured to the saddle for selectively locking the saddle to the beam.

The beam also includes a head portion which is defined by the second end of the beam. The head portion cooperates with the linkage means such that movement of the head portion induces corresponding movement of the weighted means between the first and second dispositions thereof.

In a preferred embodiment of the present invention, the first pivotal axis is disposed horizontally.

The user operated means includes a first and a second pillar slideably secured to the first and second rail portions respectively such that the pillars extend substantially vertically from the rails.

First and second guides are secured respectively adjacent to the first and second pillars for cooperating with the rails for permitting movement of the pillars along the rails relative to the first pivotal axis.

Additionally, the user operated means includes an actuating rod having an upper and a lower end. The rod is slideably supported by and between the pillars. The rod includes adjustable anchoring means for securing the lower end of the rod to the beam.

The user operated means also includes a user operated lever which is pivotally secured about a second pivotal axis which extends through the pillars.

A drum is connected to the lever such that in use of the apparatus, when the lever is pivoted by the user, the drum rotates.

A flexible strap is anchored at one end thereof to a peripheral surface defined by the drum. An opposite end of the strap is rigidly anchored to the upper end of the rod such that during rotation of the drum, the beam is pivoted about the first pivotal axis.

The weighted means includes a first arm means. The first arm means is pivotally secured to the first leg about a third pivotal axis.

A second arm means is pivotally secured to the first leg about a fourth pivotal axis. The fourth axis is disposed spaced and parallel relative to the third axis.

A link means is pivotally secured to the first and second arm means about a fifth and sixth pivotal axis respectively such that the distance between the third and fifth axes is the same as the distance between the fourth and the sixth axes respectively. The arrangement is such that when the first and second arms pivot relative to the first leg, the arms pivot parallel relative to each other. The arms are disposed closely adjacent to the first leg when the weighted means is disposed in the first disposition thereof. Furthermore, the parallel arms are disposed closely adjacent to the limiting portion when the weighted means is disposed in the second disposition thereof.

The link means also includes an extension which extends substantially vertically from the fifth pivotal axis. The arrangement is such that the extension remains substantailly vertically disposed when the weighted means moves between the first and the second disposition thereof.

Weight means are removably secured to the extension for urging the weighted means from the first towards the second disposition thereof.

The exercise apparatus also includes a further weighted means which is pivotally secured to the frame about a seventh pivotal axis.

Coupling means are provided for releasably securing the further weighted means to the weighted means such that in use of the apparatus, the user thereof initially applies the variable force to the user operated means for moving the weighted means from the first to the second disposition thereof and for thereafter moving the weighted means from the second towards the first disposition thereof. The arrangement is such that subsequently, the user selectively couples the further weighted means to the weighted means so that an increased force is required by the user thereof in order to move the combined weighted and further weighted means from the first diposition to the second disposition thereof and then back to the first disposition.

The user then repeats several cycles using the combined weighted means and when the user is unable to exert any further force in order to move the combined weighted means, the user selectively releases the coupling means to release the further weighted means so that the user is permitted to further exercise by moving only the weighted means between the first and second dispositions thereof. The arrangement is such that in use of the device, the user avoids the need for initially moving the coupled weighted means while subsequently moving the combined coupled weighted means until fully exercised. Then, the user finally gains a bonus exercise by once again moving only the weighted means to complete the exercise.

Many modifications and variations of the present invention will become readily apparent to those skilled in the art by consideration of the detailed description contained hereinafter taken in conjunction with the annexed drawings. However, such modifications and variations fall within the spirit and scope of the present invention as defined by the appended claims.

A BRIEF DESCRIPTION OF THE DRAWINGS

FIG. 3 is a similar view to that shown in FIG. 1 but shows the weighted means disposed in the second disposition thereof whereas FIG. 1 shows the weighted means in the first dispostion thereof;

Similar reference characters refer to similar parts throughout the various views of the prefered embodiment.

DETAILED DESCRIPTION OF THE DRAWINGS

Figure 1:
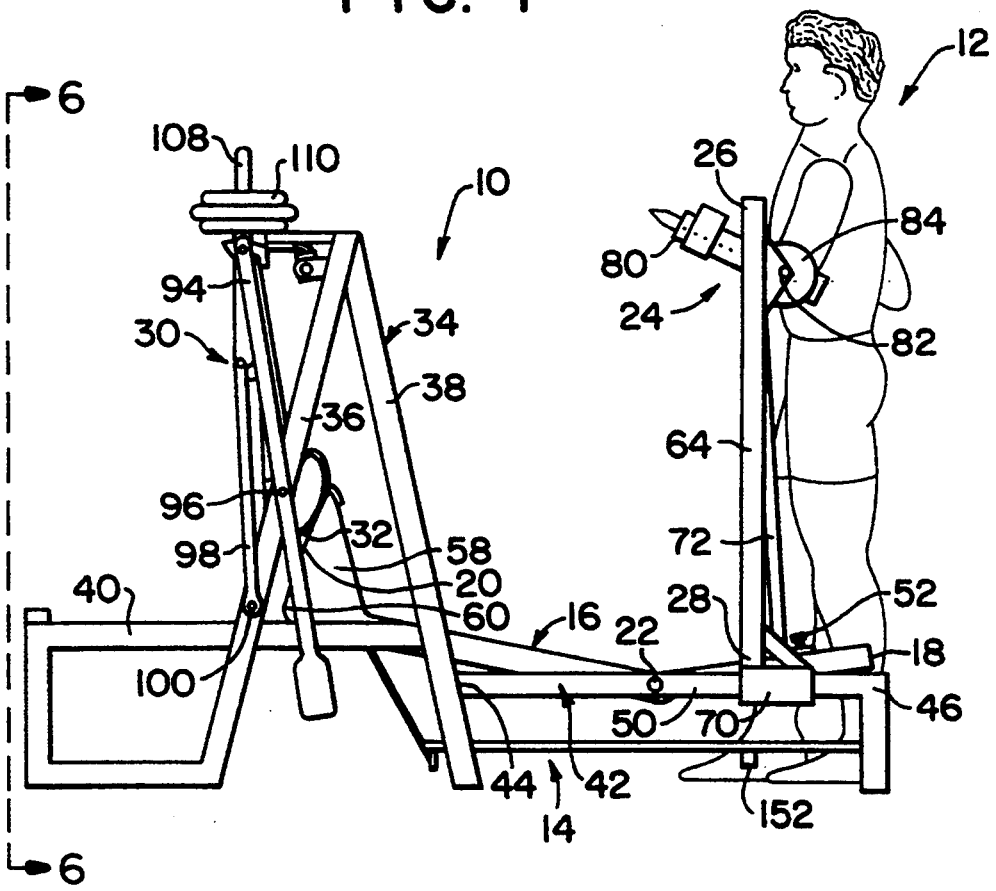
FIG. 1 is a side elevational view of the exercise apparatus according to the present invention.

FIGS. 1 to 6 show an exercise apparatus generally designated 10 for exercising a user thereof 12. The apparatus 10 includes a frame generally designated 14 and an elongate beam generally designated 16 having a first and second end 18 and 20 respectively. The beam 16 is pivotally secured to the frame 14 about a first pivotal axis 22 disposed between the first and second end 18 and 20 respectively of the beam 16.

A user operated means generally designated 24 has a first and a second extremity 26 and 28 respectively. The user operated means 24 is connected to the beam 16 between the first end 18 of the beam 16 and the first pivotal axis 22. The arrangement is such that in use of the apparatus 10, when the user 12 is exercising, the user 12 exerts a variable force through the user operated means 24. The variable force is transmitted to the beam 16 for pivoting the beam 16 about the first pivotal axis 22.

Figure 3:
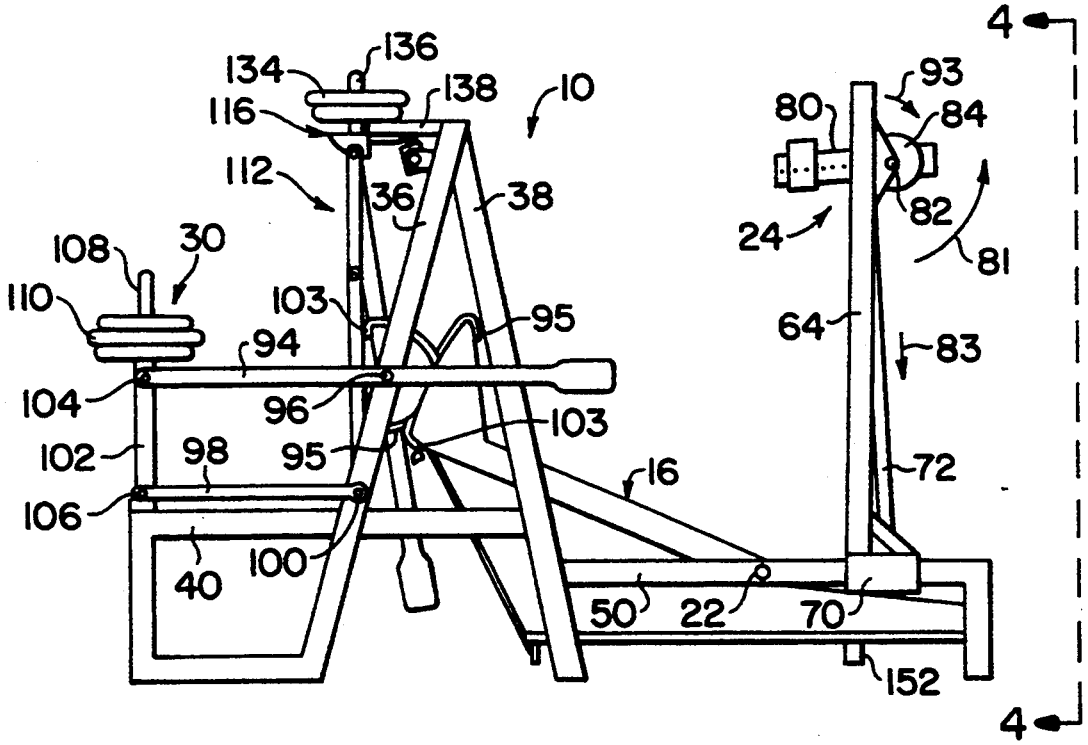

Weighted means generally designated 30 is pivotally secured to the frame 14 so that in use of the apparatus 10, movement of the weighted means 30 from a first disposition as shown in FIG. 1 to a second disposition thereof as shown in FIG. 3 is permitted.

Linkage means 32 extends from the second end 20 of the beam 16 to the weighted means 30 such that is use of the apparatus 10 during the beginning of an exercise, the weighted means 30 is disposed in the first disposition thereof as shown in FIG. 1 so that a minimal force is required to maintain the weighted means 30 from movement thereof from the first disposition shown in FIG. 1 to the second disposition shown in FIG. 3.

However, during further exercising movement of the user 12, a further force greater than the minimal force is required in order to counteract a tendency for the weighted means 30 to move towards the second dispostion thereof so that the variable force is applied by the user during use of the apparatus 10.

The frame 14 also includes an A-shaped central portion generally designated 34 having a first and a second leg 36 and 38 respectively. The first leg 36 pivotally supports the weighted means 30.

A limiting portion 40 is rigidly secured to the first leg 36 for limiting movement of the weighted means 30 such that when the weighted means 30 pivots to the second disposition thereof as shown in FIG. 3, further movement of the weighted means 30 is inhibited by the limiting portion 40.

A beam supporting portion generally designated 42 has a proximal end 44 and a distal end 46. The proximal end 44 of the supporting portion 42 is rigidly secured to the second leg 38 and extends therefrom. The arrangement is such that the first pivotal axis 22 is disposed between the proximal and the distal ends 44 and 46 respectively of the supporting portion 42.

Figure 2:
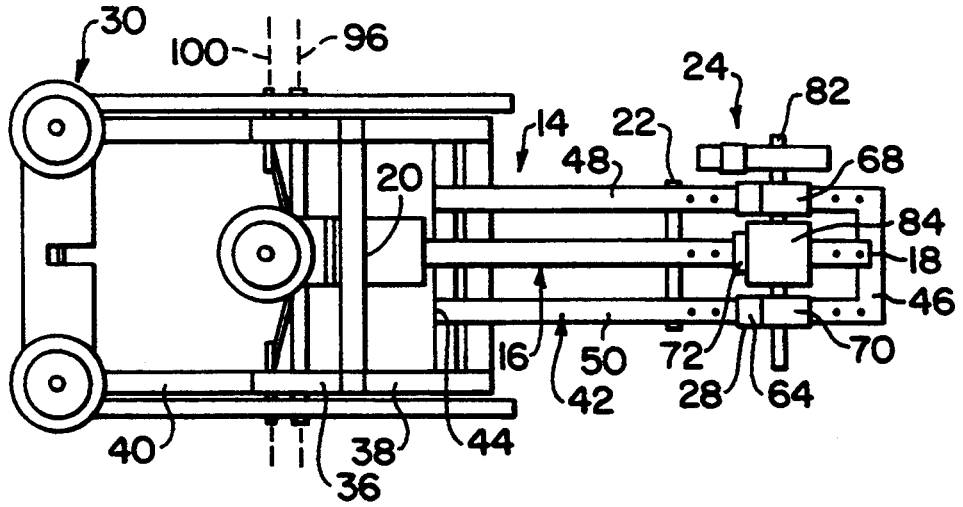
FIG. 2 is a top plan view of the apparatus shown in FIG. 1.

The beam supporting portion 42 also includes a first and a second rail 48 and 50 respectively shown particularly in FIG. 2. The first pivotal axis 22 extends normally through the rail portions 48 and 50.

Figure 4:
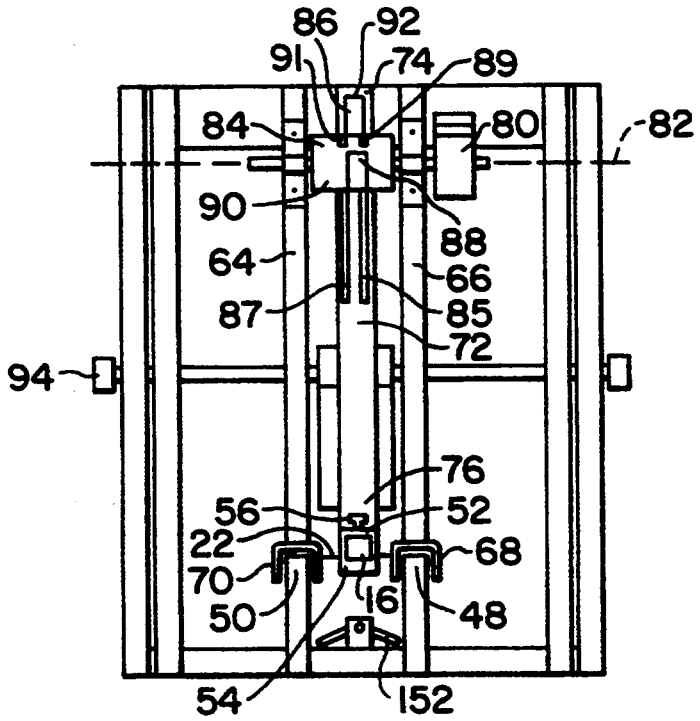
FIG. 4 is a view taken on the line 4—4 of FIG. 3.

FIG. 4 is a view taken on the line 4—4 of FIG. 3. As shown in FIG. 4 beam 16 also includes adjustable anchor means 52 for adjustably securing the user operated means 24 to the beam 16 such that selective securing of the user operated means 24 at a variable distance from the pivotal axis 22 of the beam 16 is permitted.

The anchor means 52 also includes a saddle 54 rigidly secured to the user operated means 24 for cooperating with and slideably engaging the beam 16.

Locking means 56 are secured to the saddle 54 for selectively locking the saddle 54 to the beam 16.

The beam 16 also includes a head portion 58 which is defined by the second end 20 of the beam 16. The head portion 58 has a curved surface 60 which co-operates with the linkage means 32 such that movement of the head portion 58 induces corresponding movement of the weighted means 30 between the first and second dispositions thereof.

As shown in FIGS. 1–5, the first pivotal axis 22 is disposed horizontally.

The user operated means 24 includes a first and a second pillar 64 and 66 respectively shown in FIG. 4. The pillars 64 and 66 are slideably secured to the first and second rail portions 48 and 50 respectively such that the pillars 64 and 66 extend substantially vertically from the rails 48 and 50.

First and second guides 68 and 70 shown in FIG. 4 are secured respectively adjacent to the first and second pillars 64 and 66 for cooperating with the rails 48 and 50 for permitting movement of the pillars 64 and 66 along the rails 48 and 50 relative to the first pivotal axis 22.

The user operated means 24 further includes an actuating rod 72 shown in FIG. 4. The actuating rod 72 has an upper and a lower end 74 and 76 respectively. The rod 72 is slideably supported by and between the pillars 64 and 66. The rod 72 includes the adjustable anchoring means 52 for securing the lower end 76 of the rod 72 to the beam 16.

The user operated means 24 includes a user operated lever 80 which is pivotally secured about a second pivotal axis 82 which extends through an extension of the pillars 64 and 66.

A drum 84 is connected to the lever 80 such that in use of the apparatus 10 when the lever 80 is pivoted, the drum 84 rotates.

A flexible strap 86 is anchored at one end 88 thereof to a peripheral surface 90 defined by the drum 84. An opposite end 92 of the strap 86 is rigidly anchored to the upper end 74 of the rod 72 such that during rotation of the drum 84, the beam 16 is pivoted about the first pivotal axis 22.

The weighted means 30 includes a first arm means 94 which is pivotally secured to the first leg 36 about a third pivotal axis 96.

A second arm means 98 is pivotally secured to the first leg 36 about a fourth pivotal axis 100. The fourth axis 100 is disposed spaced and parallel relative to the third axis 96.

A link means 102 shown particularly in FIG. 3 is pivotally secured to the first and second arm means 94 and 98 about a fifth and sixth pivotal axis 104 and 106 respectively. The arrangement is such that when the first and second arms 94 and 98 pivot relative to the first leg 36, the arms 94 and 98 pivot substantially parallel relative to each other. The arms 94 and 98 are disposed closely adjacent to the first leg 36 when the weighted means 30 is disposed in the first disposition thereof as shown in FIG. 1.

Similarly, the parallel arms 94 and 98 are disposed closely adjacent to the limiting portion 40 when the weighted means 30 is disposed in the second disposition thereof as shown in FIG. 3.

The link means 102 also includes an extension 108 which extends substantially vertically from the fifth pivotal axis 104. The arrangement is such that the extension 108 remains substantially vertically disposed when the weighted means moves between the first and the second disposition thereof.

Weight means 110 is removably secured to the extension 108 for urging the weighted means 30 from the first towards the second disposition thereof.

Figure 6:
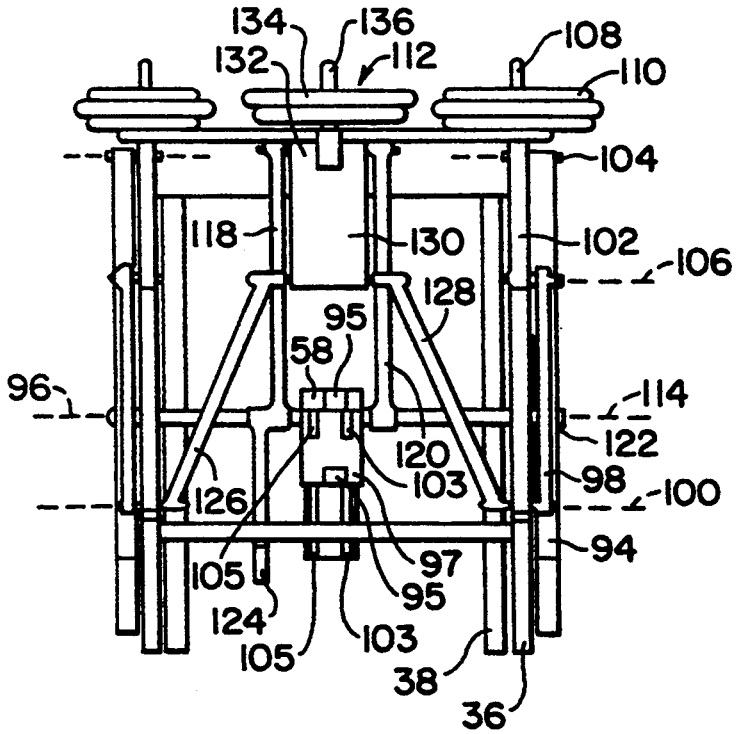
FIG. 6 is a view taken on the line 6—6 shown in FIG. 1.

FIG. 3 also shows the exercise apparatus 10 as including a further weighted means generally designated 112 pivotally secured to the frame 14 about a seventh pivotal axis 114 which is coincident with axis 96 as shown in FIG. 6.

Coupling means generally designated 116 to be described in greater detail hereinafter releasably secure the further weighted means 112 to the weighted means 30 such that in use of the apparatus 10, the user thereof initially supplies the variable force to the user operated means 24 for moving the weighted means 30 from the first to the second dispostion thereof and for thereafter moving the weighted means 30 from the second towards the first dispostion thereof.

The arrangement is such that subsequently, the user selectively couples the further weighted means 112 to the weighted means 30 so that an increased force is required by the user thereof in order to move the combined weighted and further weighted means 30 and 112 respectively from the first dispostion to the second disposition thereof and then back to the first disposition.

The user then repeats several cycles or "reps" using the combined weighted means 30 and 112 and when the user is unable to exert any further force in order to move the combined weighted means 30 and 112 the user selectively releases the coupling means 116 to release the further weighted means 112 so that the user is permitted to further exercise by moving only the weighted means 30 between the first and second dispostions thereof. The arrangement is such that the user 12 avoids the need to initially move the coupled weighted means 30 and 112 while subsequently moving the combined coupled weighted means 30 and 112 until fully exercised. Then finally, the user gains a bonus exercise by once again moving only the weighted means 30 to complete the exercise.

More specifically, the further weighted means 112 includes a first and second arm 118 and 120. As shown in FIG. 6, the arms 118 and 120 are pivotally secured so that they can rotate around axis 114. However, although the arm 94 is rigidly secured to the shaft 122 for rotational axis around axes 96 and 114, the arms 118 and 120 slidingly co-operate with a shaft 122.

Furthermore, arm 118 includes a counter weight extension 124.

Additionally, the further weighted means includes diagonal arms 126 and 128. The arms 126 and 728 are pivotally secured to the arm 36 about axis 100 whereas the upper ends of the arms 126, 128 are pivotally secured to the lower end of a rectangular member 130.

The upper end 132 of the rectangular member 130 is pivotally secured to the upper ends respectively of the arms 118 and 120. The arrangement is such that the further weighted means 112 is permitted to pivot from a first location as shown in FIG. 3 to a second location shown in FIG. 5, the second location being substantially the same when viewed sideways as in FIG. 5 to the second disposition of the weighted means 30 shown in FIG. 5.

Figure 5:
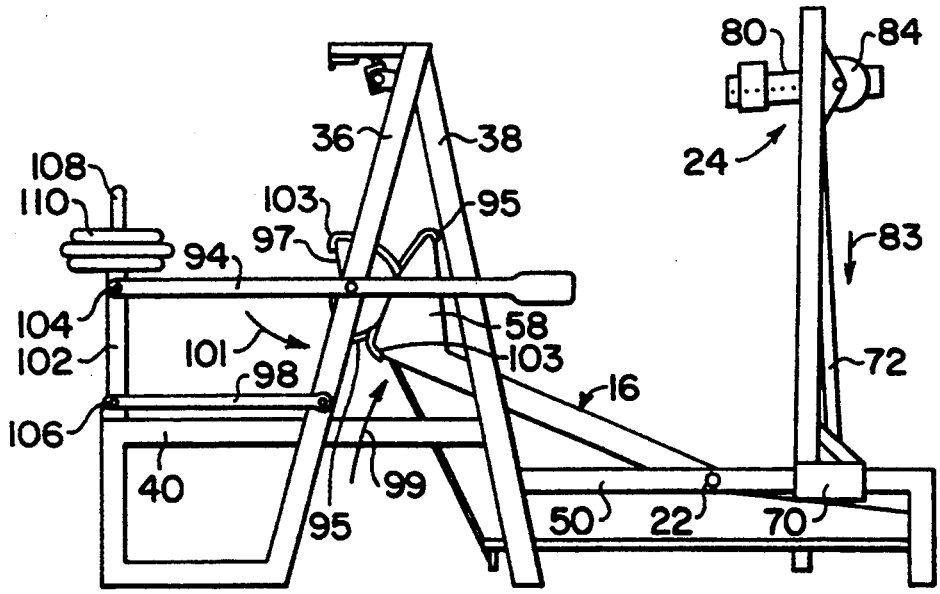
FIG. 5 is a view similar to that shown in FIG. 1 but with both the weighted means in the second disposition and the further weighted means in the second location.

As shown in FIGS. 3, and 6, the further weighted means 112 includes further weights 134 removably supported on an extension 136 of the rectangular member 130 so that when the further weighted means 112 moves between the first and second location thereof as shown in FIGS. 3 and 5 respectively, the extension 136 always remains vertically disposed.

Figure 7:
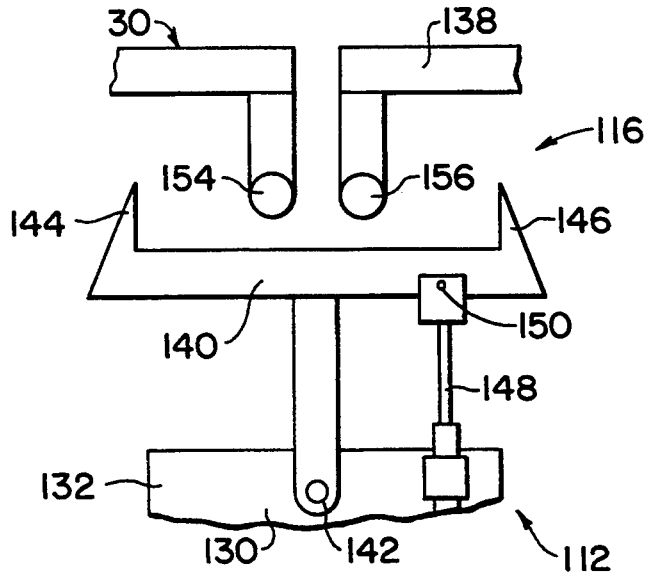
FIG. 7 is an enlarged side elevational view of the release mechanism showing the catch locking both the weighted and further weighted means.
Figure 8:
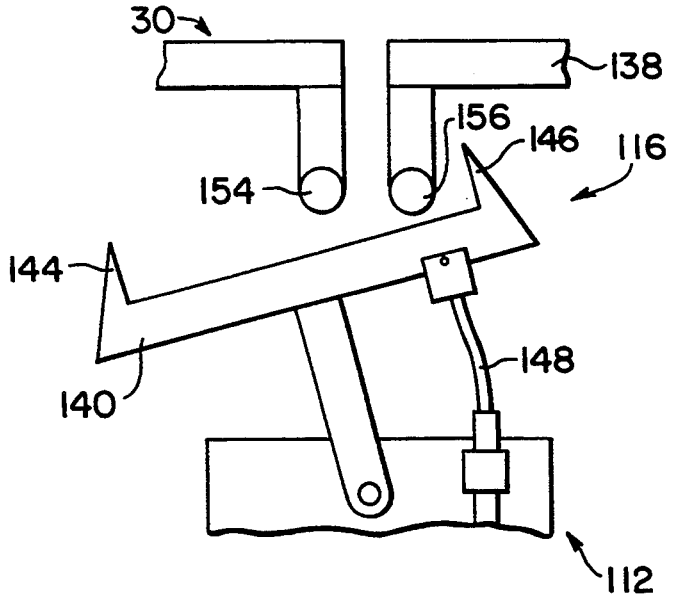
FIG. 8 is a similar view to that shown in FIG. 7 but showing the catch locking the further weighted means and releasing the weighted means for pivotal movement thereof.
Figure 9:
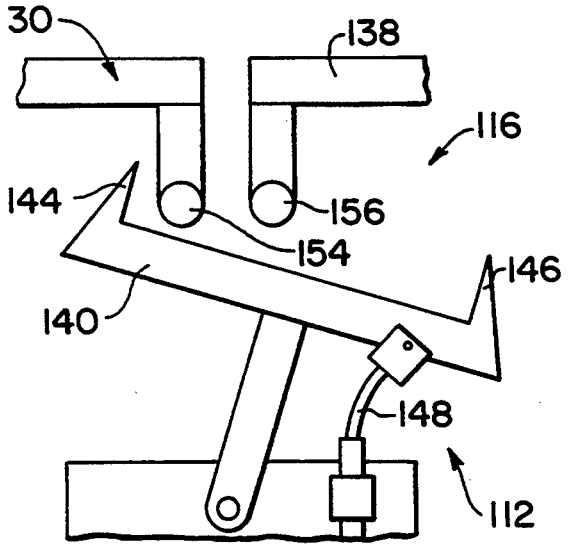
FIG. 9 is a view similar to that shown in FIG. 7 but showing the catch releasing both the weighted and further weighted means for pivotal movement thereof.

The coupling means 116 is shown in more detail in FIGS. 7, 8 and 9. Generally, the coupling means 116 enable the weighted means 30 to be released from the further weighted means 112 while the further weighted means is anchored to a plate 138 extending from the upper end of the arm 36.

Additionally, the coupling means 116 enables the selected coupling of the further weighted means 112 to the weighted means 30 so that the combined weighted means 30 and 112 may be pivoted to the position shown in FIG. 5 where both the weighted means 30 and 112 are released from the plate 138.

Furthermore, the coupling means 116 permits locking of both the weighted means 30 and the further weighted means 112 to the plate 138 so that the weighted means 30 and 112 are locked in the disposition and location as shown in FIG. 1.

FIGS. 7, 8 and 9, show in more detail the coupling means 116.

In the preferred embodiment of the present invention, the coupling means 116 includes a catch 140 pivotally secured at 142 to the upper end 132 of the rectangular member 130. The catch 140 has a first and a second stop 144 and 146 respectively. A control cable 148 is anchored to the upper end 132 and pivotally secured at 150 to the catch 140. Movement of the cable 148 is controlled by a foot pedal mechanism 152 shown specifically in FIG. 4. The foot pedal 152 can be operated by the user from either side of the exercise apparatus.

In the location of the catch 140 as shown in FIG. 7, movement of both the weighted means 30 and 112 are locked relative to the plate 138 by the interaction of arms 154 and 156 with the stops 144 and 146 respectively. In this mode, both of the weighted means 30 and further weighted means 112 are locked in the location as shown in FIG. 1.

When the catch 140 is pivoted to the disposition shown in FIG. 8, the further weighted means 112 is locked to the plate 138 by the interaction of arm 156 and stop 146. However, the weighted means 30 is free to pivot because the stop 144 is now disposed below the arc of movement of arm 154 so tha the weighted means 30 can move to the second disposition shown in FIG. 3 while the further weighted means 112 is locked to the plate 138.

When the control cable 148 is moved by pedal 152 to the location shown in FIG. 9, the catch 140 releases the further weighted means 112 from engagement with the plate 138 because the stop 146 is pivoted below the arm 156. However, the arm 154 of the weighted means 30 is engaged by the stop 144 so that the further weighted means 112 is anchored to and moves with the weighted means 30 due to the interaction of stop 144 and arm 154 so that both the weighted and further weighted means 30,112 may be moved to the location shown in FIG. 5.

It will be understood by those skilled in the art that although the lever 80 is shown in one pivotal location for exercising for example the arm and shoulder muscles of the user, the location of the lever 80 can be relocated to a variety of positions and locations on either side of the apparatus for permitting a multitude of exercise movements.

As shown in FIG. 4 the strap 86 is a flexible means and is made preferably from reinforced belting material similar to that used in an auto safety harness. The flexible means 86 is anchored at 92 to the upper end 74 of the rod 72. The other end is secured to the drum 84 at 88 so that when the lever 80 is rotated in the direction as indicated by the arrow 81 shown in FIG. 3, the rod 72 moves downwardly as indicated by the arrow 83. However, the strap 86 also includes a bifurcated portion 85 and 87 secured to the rod 72 below the drum 84. The upper ends 89 and 91 of portions 85 and 87 are secured to the drum 84 so that when the lever 80 rotates the drum in the direction 93, the rod moves upwardly in a direction opposite to the direction indicated by arrow 83.

Similarly, as shown particularly in FIG. 6, a single flexible means or belt 95 is secured to a semicircular member 97 shown in FIG. 5. The other end of 95 is anchored to the head portion 58 so that as the head 58 moves up as indicated by the arrow 99 when the rod 72 moves down as indicated by arrow 83, the member 97 rotates in the direction shown by arrow 101. The linkage means 32 shown in FIG. 1 includes not only belt 95 but also a further double type belt 103 and 105 shown in FIG. 6. Belts 103 and 105 are fastened to the member 97 opposite the belt 95. The belts 103 and 105 ride on the circumference of the member 97 and are anchored at the other ends thereof to the lower end of the head 58. The arrangement is such that when the rod 72 moves upwardly, the head 58 moves downwardly in an opposite direction to arrow 99. Therefore, the belts 103,105 rotate the member 97 in a direction opposite to the direction of arrow 101 for lifting the weights to the upper disposition and location.

The present invention provides a user controlled means for selectively adjusting the amount of weight lifted by the user in order to maximize the benefits derived from the exercise.

What is claimed is:

1. An exercise apparatus for exercising a user thereof, said apparatus comprising:

a frame;

an elongate beam having a first and a second end, said beam being pivotally secured to said frame about a first pivotal axis disposed between said first and second end of said beam;

user operated means having a first and a second extremity, said operated means being connected to said beam between said first end of said beam and said first pivotal axis, the arrangement being such that in use of the apparatus, when the user is exercising, the user may exert a variable force through said user operated means, said variable force being transmitted to said beam for pivoting said beam about said first pivotal axis;

weighted means pivotally secured to said frame such that in use of the apparatus, movement of said weighted means from a first to a second disposition thereof is permitted;

linkage means extending from said second end of said beam to said weighted means for drivingly engaging and weighted means such that in use of the apparatus during the beginning of an exercise, said weighted means is disposed in said first dispostion thereof so that a minimal force is required to maintain said weighted means from movement thereof from said first to said second disposition, however, during further exercising movement of the user, a further force greater than said minimal force is required in order to counteract a tendency for said weighted means to move from said first towards said second disposition thereof so that said variable force is applied by the user during use of the apparatus;

said frame further including:

an A-shaped central portion having a first and a second leg, said first leg thereof pivotally supporting said weighted means;

a limiting portion rigidly secured to said first leg for limiting movement of said weighted means such that when said weighted means pivots to said second dispostion thereof, further movement of said weighted means is inhibited by said limiting portion;

a beam supporting portion having a proximal and a distal end, said proximal end of said supporting portion being rigidly secured to said second leg and extending therefrom, the arrangement being such that said first pivotal axis is disposed between said proximal and said distal end of said supporting portion; and said beam supporting portion further including:

a first and a second rail portion, said first pivotal axis extending normally through said rail portions.

2. An exercise apparatus as set forth in claim 1 wherein said beam further includes:

a head portion defined by said second end of said beam, said head portion having a curved surface which cooperates with said linkage means such that movement of said head portion induces corresponding movement of said weighted means between said first and second dispositions thereof.

3. An exercise apparatus as set forth in claim 1 wherein said first pivotal axis is disposed horizontally.

4. An exercise apparatus as set forth in claim 1 wherein said user operated means includes:

a first and a second pillar slidably secured to said first and second rail portions respectively such that said pillars extend substantially vertically from said rails;

first and second guides secured respectively adjacent to said first and second pillars for cooperating with said rails for permitting movement of said pillars along said rails relative to said first pivotal axis.

5. An exercise apparatus as set forth in claim 4 wherein said user operated means further includes:

an actuating rod having an upper and a lower end, said rod being slidably supported by and between said pillars, said rod including:

adjustable anchoring means for securing said lower end of said rod to said beam.

6. An exercise apparatus as set forth in claim 5 wherein said user operated means includes:

a user operated lever, pivotally secured about a second pivotal axis which extends through said pillars;

a drum connected to said lever such that in use of the apparatus, when said lever is pivoted, said drum rotates;

a flexible strap anchored at one end thereof to a peripheral surface defined by said drum, an opposite end of said strap being rigidly anchored to said upper end of said rod such that during rotation of said drum, said beam is pivoted about said first pivotal axis.

7. An exercise apparatus as set forth in claim 1 further including:

a further weighted means pivotally secured to said frame about an a further pivotal axis;

coupling means for releasably securing said further weighted means to said weighted means such that in use of said apparatus, the user thereof may initially apply said variable force to said user operated means for moving said weighted means from said first to said second disposition thereof and for thereafter moving said weighted means from said second towards said first disposition thereof, the arrangement being such that subsequently, the user may selectively couple said further weighted means to said weighted means so that an increased force is required by the user thereof in order to move the combined weighted and further weighted means from said first disposition to said second dispostion thereof and then back to said first disposition, the user may then repeat several cycles using the combined weighted means and when the user is unable to exert any further force in order to move said combined weighted means, the user may selectively release said coupling means to release said further weighted means so that the user is permitted to further exercise by moving only the weighted means between said first and second dispositions thereof, the arrangement being such that the user avoids the need to initially move the coupled weighted means while subsequently moving the combined coupled weighted means until fully exercised, and then finally gaining an additional exercise by once again moving only said weighted means to complete the exercise.

8. An exercise apparatus for exercising a user thereof, said apparatus comprising:

a frame;

an elongate beam having a first and a second end, said beam being pivotally secured to said frame about a first pivotal axis disposed between said first and second end of said beam;

user operated means having a first and a second extremity, said operated means being connected to said beam between said first end of said beam and said first pivotal axis, the arrangement being such that in use of the apparatus, when the user is exercising, the user any exert a variable force through said user operated means, said variable force being transmitted to said beam for pivoting said beam about said first pivotal axis;

weighted means pivotally secured to said frame such that in use of the apparatus, movement of said weighted means from a first to a second disposition thereof is permitted;

linkage means extending from said second end of said beam to said weighted means such that in use of the apparatus during the beginning of an exercise, said weighted means is disposed in said first dispostion thereof so that a minimal force is required to maintain said weighted means from movement thereof from said first to said second disposition, however, during further exercising movement of the user, a further force greater than said minimal force is required in order to counteract a tendency for said weighted means to move from said first towards said second disposition thereof so that said variable force is applied by the user during use of the apparatus;

said beam further including:

adjustable anchor means for adjustably securing said first extremity of said user operated means to said beam such that selective securing of said first extremity at a variable distance from said first pivotal axis of said beam is permitted.

9. An exercise apparatus as set forth in claim 8 wherein said anchor means includes:

a saddle rigidly secured to said first extremity of said user operated means for cooperating with and slidably engaging said beam;

locking means secured to said saddle for selectively locking said saddle to said beam.

10. An exercise apparatus for exercising a user thereof, said apparatus comprising:

a frame;

an elongate beam having a first and a second end, said beam being pivotally secured to said frame about a first pivotal axis disposed between said first and second end of said beam;

user operated means having a first and a second extremity, said operated means being connected to said beam between said first end of said beam and said first pivotal axis, the arrangement being such that in use of the apparatus, when the user is exercising, the user exerts a variable force through said user operated means, said variable force being transmitted to said beam for pivoting said beam about said first pivotal axis;

weighted means pivotally secured to said frame such that in use of the apparatus, movement of said weighted means from a first to a second disposition thereof is permitted;

linkage means extending from said second end of said beam to said weighted means such that in use of the apparatus during the beginning of an exercise, said weighted means is disposed in said first dispostion thereof so that a minimal force is required to maintain said weighted means from movement thereof from said first to said second disposition, however, during further exercising movement of the user, a further force greater than said minimal force is required in order to counteract a tendency for said weighted means to move from said first towards said second disposition thereof so that said variable force is applied by the user during use of the apparatus;

said frame further including:

an A-shaped central portion having a first and a second leg, said first leg thereof pivotally supporting said weighted means;

a limiting portion rigidly secured to said first leg for limiting movement of said weighted means such that when said weighted means pivots to said second dispostion thereof, further movement of said weighted means is inhibited by said limiting portion;

a beam supporting portion having a proximal and a distal end, said proximal end of said supporting portion being rigidly secured to said second leg and extending therefrom, the arrangement being such that said first pivotal axis is disposed between said proximal and said distal end of said supporting portion;

said weighted means including:

a first arm means, said first arm means being pivotally secured to said first leg about a third pivotal axis;

a second arm means being pivotally secured to said first leg about a fourth pivotal axis, said fourth axis being disposed spaced and parallel relative to said third axis;

a link means pivotally secured to said first and second arm means about a fifth and sixth pivotal axis respectively such that the distance between the third and fifth axes is the same as the distance between the fourth and the sixth axes respectively, the arrangement being such that when said first and second arms pivot relative to said first leg, said arms pivot parallel relative to each other, said arms being disposed closely adjacent to said first leg when said weighted means is disposed in said first disposition thereof, said parallel arms being disposed closely adjacent to said limiting portion when said weighted means is disposed in said second disposition thereof;

said link means further including:

an extension extending substantially vertically from said fifth pivotal axis, the arrangement being such that said extension remains substantially vertically disposed when said weighted means moves between said first and second disposition thereof;

weight means removably secured to said extension for urging said weighted means from said first towards said second disposition thereof.

* * * * *